US005823364A

United States Patent [19]

Mucciacciaro

[11] Patent Number: 5,823,364

[45] Date of Patent: Oct. 20, 1998

[54] WALL MOUNTED TOOL RACK

[76] Inventor: Dominic Mucciacciaro, 1791 Blount Rd., Suite 901, Pompano Beach, Fla. 33069

[21] Appl. No.: 813,046

[22] Filed: Mar. 7, 1997

[51] Int. Cl.[6] ..... A47F 7/00

[52] U.S. Cl. ..... 211/70.6; 206/372; 206/379; 206/806

[58] Field of Search ..... 248/222.41, 223.21; 211/70.6, 74; 206/372, 373, 379, 443, 806; 40/617

[56] References Cited

U.S. PATENT DOCUMENTS

| | | | |
|---|---|---|---|
| 1,914,276 | 6/1933 | Moore | 206/373 X |
| 2,829,778 | 4/1958 | Carabet | 206/373 X |
| 3,269,550 | 8/1966 | Marcus | 211/70.6 |
| 4,030,599 | 6/1977 | Bruni | 211/70.6 X |
| 4,759,441 | 7/1988 | Leurck | 206/373 |
| 4,813,551 | 3/1989 | Kuo | 211/70.6 |
| 4,871,074 | 10/1989 | Bryson et al. | 211/70.6 X |
| 4,880,122 | 11/1989 | Martindell | 211/70.6 |
| 5,005,710 | 4/1991 | Hofer | 211/70.6 |
| 5,048,700 | 9/1991 | Feder | 211/70.6 |
| 5,499,711 | 3/1996 | Kozak | 206/372 X |
| 5,638,964 | 6/1997 | Ernst | 211/70.6 |
| 5,641,079 | 6/1997 | Schmidt | 211/70.6 |

*Primary Examiner*—Ramon O Ramirez
*Assistant Examiner*—Long Dinh Phan
*Attorney, Agent, or Firm*—Alvin S. Blum

[57] ABSTRACT

A rack for tool bits has many apertures in its horizontal top panel for receiving the drill bits, turning tools, and the like. Each aperture may be provided with a soft plastic bushing to prevent damage to the tool edge. A back vertical panel depending from the top panel is provided with rack supporting mechanisms for removably supporting the rack on the vertical wall of a stationary machine tool. The supporting means may include magnetic elements or preferably keyhole shaped apertures in the back panel that cooperate with shouldered machine screws affixed to the vertical wall of the machine tool. A cork surface on a front vertical panel of the rack may be provided for tacking on memos.

18 Claims, 1 Drawing Sheet

WALL MOUNTED TOOL RACK

BACKGROUND OF THE INVENTION

This invention relates to a rack for holding tool bits and, more particularly, to a tool rack that removably mounts upon a vertical wall adjacent a machine tool such as a machining center, a lathe or milling machine.

When working at a machine tool such as a machining center, lathe or milling machine, various tool bits such as drills, end mills, turning tools and the like must be available to the operator. Often as many as ten different tools must be attached to the machine at different times during the working of a single workpiece. To keep so many small pieces conveniently at hand, it is the usual practice to provide a rolling stand with a perforated horizontal top. The perforations are adapted to receive one tool in each aperture. The stand is large enough to hold a large variety of tools, often many more than is needed for a particular job.

Although this is convenient for the operator, the large stand on the floor adjacent to the operator is often in the traffic pattern of the shop. It creates a hazard and may impede movement about the shop for the workers and items they may need to carry about.

SUMMARY OF THE INVENTION

It is, accordingly, an object of the invention to provide tool racks that may be positioned conveniently adjacent the machine operator without interfering with floor space and traffic patterns. Many modern machine tools have enclosures with vertical walls that enclose the moving parts. It is an object of the invention to employ those vertical walls adjacent the operator to support small removable racks. A series of these racks may be mounted side by side or one above the other on the vertical wall. Each rack has a horizontal surface with multiple apertures for receiving one tool bit or other tool in each aperture. An elongate vertical wall of the rack is provided with keyhole shaped apertures. The vertical wall of the machine tool is provided with shouldered bolts for engaging the keyhole shaped apertures. The rack may be easily lifted onto the bolts on the wall or removed without special effort or skills to be taken to the tool storage area to be filled with the tools necessary for a particular job. The rack only extends from the wall about 5 inches, so it does not interfere with traffic. As many racks as necessary are hung on the wall usually one over the other, without occupying useful space. Many of these tools have extremely sharp, precisely positioned edges. It is important that these edges not be disturbed by insertion and removal from the rack. When the rack is made of metal, each opening in the top is provided with a soft bushing such as plastic to prevent damage to the tool. Alternatively, the rack may be made of rigid plastic that will not damage the tool. Each opening is provided with an edge that is softer than aluminum to guard against tool cutting edge damage. Aluminum has a maximum hardness of about 95 on the Brinell scale.

These and other objects, advantages, and features of the invention will become more apparent when the detailed description is considered in conjunction with the drawings, in which like elements are indicated by like reference characters in the various drawing figures.

DETAILED DESCRIPTION OF PREFERRED EMBODIMENTS

Figure 1:
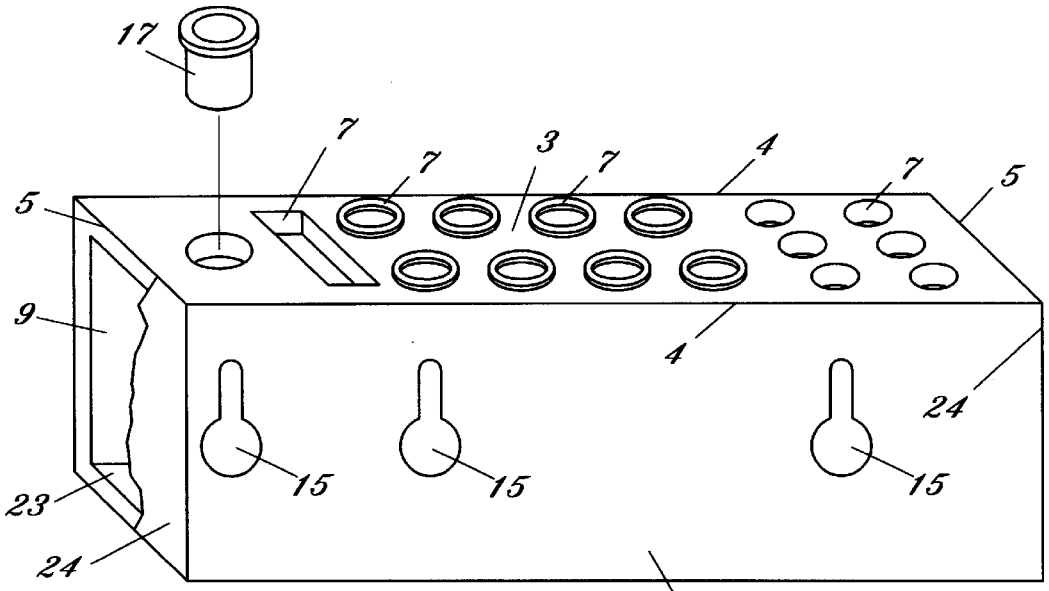
FIG. 1 is a perspective view of the rack of the invention with an end wall partially broken away.
Figure 2:
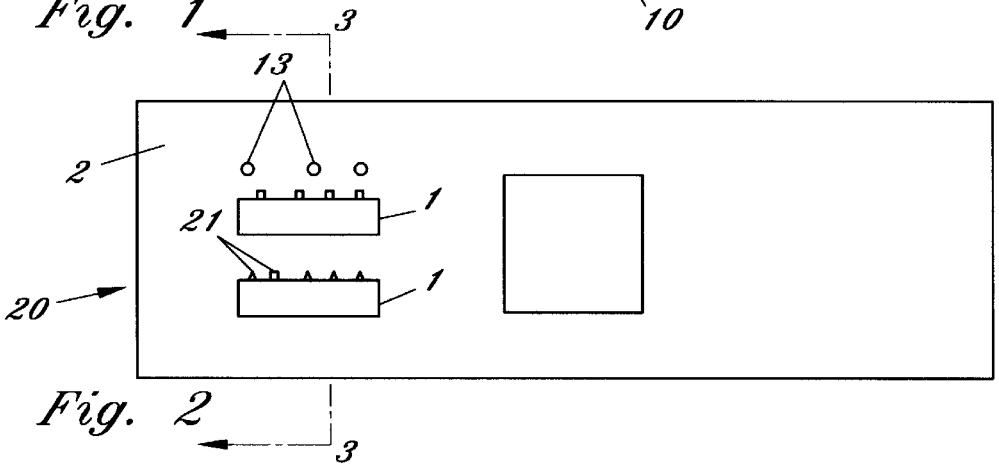
FIG. 2 is a front elevation view of a machining center with two racks in place.
Figure 3:
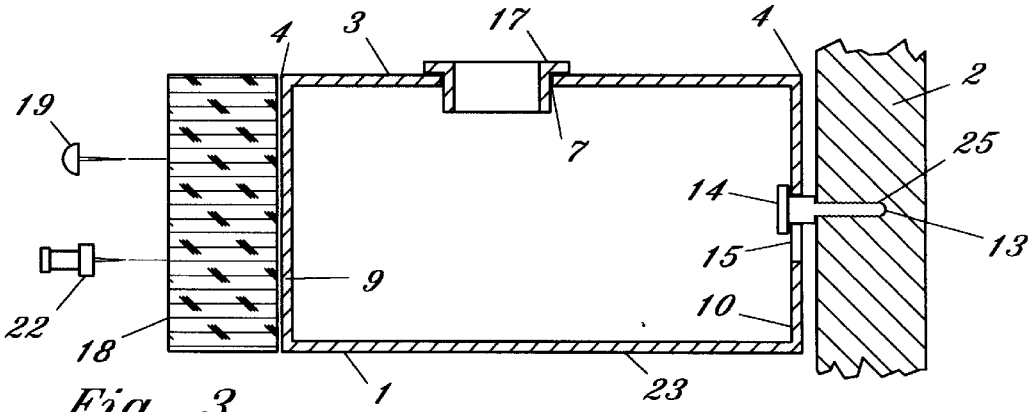
FIG. 3 is a sectional view taken on line 3—3 of FIG. 2.

Referring now to FIGS. 1–3, a stationary machine tool 20 having an exposed vertical wall 2 of the type commonly found in machine shops, including machining centers, milling machines, lathes, grinders and the like may require a variety of replaceable tools 21. These may include milling cutters, drill bits, turning tools, tool holders and the like. These may be specially selected and fashioned for a particular job. The rack 1 of the invention is provided with a plurality of apertures 7 of various shapes to hold the various tools. The apertures may be provided with soft plastic bushing 17 to prevent damage to the sharp edges of the cutting tools. The rack comprises an elongate horizontal top surface 3 with the apertures 7, the top surface being generally rectangular and having two long edges 4 that are at least three times the length of the two short edges 5. Depending from the long edges 4 are opposed parallel front vertical panel 9 and back vertical panel 10. The bottom panel 23 joins the two vertical panels. The hollow rack may also be joined by side vertical panels 24. Means are further provided for removably supporting the rack 1 on the vertical wall 2. The rack supporting means shown are preferred, but the invention may employ other well known removable support means as well such as spring clips or magnets.

The rack supporting means shown includes shouldered machine screws 13 which are affixed to the wall 2 by screwing them into drilled and tapped holes 25 in the wall. Keyhole shaped perforations or apertures 15, being at least two in number, are provided in the back vertical panel 9. These are arranged to removably receive the heads 14 of the screws 13 and hold securely when the rack is lowered. The front vertical panel 9 of the rack may have a resilient front layer 18 attached thereto such as cork or foam to receive thumbtacks 19 or pushpins 22 to hold papers such as work orders, prints, memos and the like.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A rack assembly for holding small tools on the vertical wall of a stationary machine tool, the rack assembly comprising:

a hollow rack having an elongate horizontal top surface, the top surface being substantially rectangular and having opposed short edges and opposed long edges that are at least three times as long as the short edges, and having a plurality of tool receiving apertures therethrough, the apertures provided with edges that are softer than aluminum maximum harness of 95 on the Brinell scale;

a front vertical panel and an opposed back vertical panel depending from the long edges;

a plurality of rack supporting means for supporting the rack against the vertical wall of a stationary machine tool, each rack supporting means provided with a first means for fixed attachment to said vertical wall and a second means for removably engaging said back vertical panel; and said back vertical panel provided with means for cooperating with said rack supporting means to removably mount the rack on said vertical wall with said back vertical panel against said vertical wall without tools so that the rack may be readily removed from the wall by lifting and pulling the rack away from the wall or simply pulling the rack away away from the wall.

2. The assembly according to claim 1, in which said rack supporting means are shouldered bolt assemblies and said means for cooperating with said rack supporting means are keyhole shaped apertures in said back vertical panel.

3. The assembly according to claim 2, in which the rack is made of metal, and the tool receiving apertures are provided with bushings made of a material softer than (said) metal.

4. The assembly according to claim 3, in which said material is a plastic.

5. The assembly according to claim 4, in which said front vertical panel is provided with a surface adapted for receiving thumbtacks or pushpins.

6. The assembly according to claim 1, in which the rack is made of metal, and the tool receiving apertures are provided with bushings made of a material softer than said metal.

7. The assembly according to claim 6, in which said material is a plastic.

8. The assembly according to claim 1, in which said front vertical panel is provided with a surface adapted for receiving thumbtacks or pushpins.

9. The assembly according to claim 7, in which said front vertical panel is provided with a surface adapted for receiving thumbtacks or pushpins.

10. A rack assembly for holding small tools on a vertical wall of a stationary machine tool, the rack assembly comprising:

a hollow rack having an elongate horizontal top surface, the top surface being substantially rectangular and having opposed short edges and opposed long edges that are at least three times as long as the short edges, and having a plurality of tool receiving apertures therethrough, the apertures provided with edge's that are softer than aluminum maximum hardness of 95 on the Brinell scale;

a front vertical panel and an opposed back vertical panel depending from the long edges;;

a plurality of rack supporting, means for supporting the rack against a vertical wall of a stationary machine tool, each rack supporting means provided with a first means for fixed attachment to said vertical wall and a second means for removably engaging said back vertical panel; and said back vertical panel provided with means for cooperating with said rack supporting means to removably mount the rack on said vertical wall with said back vertical panel against said vertical wall without tools; and in which said rack supporting means are shouldered bolt assemblies and said means for cooperating with said rack supporting means are keyhole shaped apertures in said back vertical panel.

11. The assembly according to claim 10, in which the rack is made of metal, and the tool receiving apertures are provided with bushings made of a material softer than said metal.

12. The assembly according to claim 11, in which said material is a plastic.

13. The assembly according to claim 12, in which said front vertical panel is provided with a surface adapted for receiving thumbtacks or pushpins.

14. The assembly according to claim 10, in which the rack is made of metal, and the tool receiving apertures are provided with bushings made of a material softer than said metal.

15. The assembly according to claim 14, in which said material is a plastic.

16. The assembly according to claim 10, in which said front vertical panel is provided with a surface adapted for receiving thumbtacks or pushpins.

17. The assembly according to claim 15, in which said front vertical panel is provided with a surface adapted for receiving thumbtacks or pushpins.

18. A rack assembly for holding small tools on a vertical wall of a stationary machine tool, the rack assembly comprising:

a hollow rack having an elongate horizontal top surface, the top surface being substantially rectangular and having opposed short edges and opposed long edges that are at least three times as long as the short edges, and having a plurality of tool receiving apertures therethrough, the apertures provided with edges that are softer than aluminum maximum hardness of 95 on the Brinell scale;

a front vertical panel and an opposed back vertical panel depending from the long edges;

a plurality of rack supporting means for supporting the rack against the vertical wall of a stationary machine tool, each rack supporting means provided with a first means for fixed attachment to said vertical wall and a second means for removably engaging said back vertical panel; and said back vertical panel provided with means for cooperating with said rack supporting means to removably mount the rack on said vertical wall with said back vertical panel against said vertical wall without tools so that the rack may be readily removed from the wall by lifting and pulling the rack away from the wall or simply pulling the rack away away from the wall; and in which said front vertical panel is provided with a surface constructed for receiving thumbtacks or pushpins.

* * * * *